US005762682A

United States Patent [19]

Rushe

[11] Patent Number: 5,762,682

[45] Date of Patent: Jun. 9, 1998

[54] METHOD AND APPARATUS FOR PROCESSING FERROUS MATERIALS

[75] Inventor: John Rushe, Winsford, United Kingdom

[73] Assignee: Vacmetal Limited, United Kingdom

[21] Appl. No.: 507,272

[22] PCT Filed: Dec. 21, 1994

[86] PCT No.: PCT/GB94/02778

§ 371 Date: Aug. 21, 1995

§ 102(e) Date: Aug. 21, 1995

[87] PCT Pub. No.: WO95/17528

PCT Pub. Date: Jun. 29, 1995

[30] Foreign Application Priority Data

Dec. 21, 1993 [GB] United Kingdom ..... 9326067

[51] Int. Cl.[6] ..... C21C 7/04

[52] U.S. Cl. ..... 75/531; 75/382; 75/543; 75/582; 75/378; 266/88; 266/89; 266/157; 266/207; 266/227; 266/229

[58] Field of Search ..... 75/378, 382, 531, 75/543, 582; 266/87, 88, 89, 207, 156, 227, 229

[56] References Cited

U.S. PATENT DOCUMENTS

| | | | |
|---|---|---|---|
| 3,469,740 | 9/1969 | Crowe . | |
| 3,650,517 | 3/1972 | Messing | 75/512 |
| 4,401,464 | 8/1983 | Tivelius . | |
| 4,518,422 | 5/1985 | Metz . | |

FOREIGN PATENT DOCUMENTS

| | | |
|---|---|---|
| A 0 171 350 | 2/1986 | European Pat. Off. . |
| A 2 500 608 | 8/1982 | France . |
| 1 309 453 | 5/1971 | United Kingdom . |
| 1 230 553 | 3/1973 | United Kingdom . |

OTHER PUBLICATIONS

Steel Times–Incorporating Iron & Steel, Sep. 1993, London, GB, pp. 391–392, E. Morikawa et al. 'Recent developments in the IR–UT ladle treatment process', fig. 1.

Stahl Und Eisen, vol. 109, No. 22, 10 Nov. 1989, pp. 1089–1094; G. Stolte et al., 'Das CAS/CCAS–OB–Verfahren', see figs. 1,2,7 pp. 67–72.

Patent Asbtracts of Japan, vol. 7, No. 213 (C–187) (1358) 20, Sep. 1983 & JP,A,58 110 168 (Daido Tokushuko) 1 Jul. 1983, see abstract.

Patent Abstracts of Japan, vol. 15, NO. 393 (M–1165) 4 Oct. 1991 & JP,A,03 161 160 (Nippon Steel) 11 Jul. 1991, see abstract.

*Primary Examiner*—Melvyn Andrews

*Attorney, Agent, or Firm*—Wolf, Greenfield & Sacks, P.C.

[57] ABSTRACT

In steel-making, there are conflicting processing requirements at different stages of the process. The method and apparatus of the invention creates different processing conditions at different stages of the process. Molten ferrous material (2) is stirred by bubbling a gas therethrough. A refractory ring (10) is first partially immersed in the molten steel within a substantially slag free portion of the surface of the molten ferrous metal to form a bounded substantially slag-free area. The molten steel is then heated by the introduction of exothermically reacting heating agents such as aluminium and oxygen through an oxygen gas line (7) and an aluminium delivery tube (9), respectively. The refractory ring (10) is then removed from the molten steel when the steel has reached a predetermined temperature and air is then excluded from the volume above the molten steel by placing a hood (16) over the ladle containing the molten steel. Sulphur is then removed from the steel.

20 Claims, 6 Drawing Sheets

Table 1

TYPICAL COMBINATION TREATMENT PROFILE (1)

Table 2

TYPICAL COMBINATION TREATMENT PROFILE (2)

Table 3

TYPICAL COMBINATION TREATMENT PROFILE (3)

METHOD AND APPARATUS FOR PROCESSING FERROUS MATERIALS

This invention relates to a method of processing ferrous metals including the heating of, and removal of sulphur from, a molten ferrous metal.

The molten ferrous metal is heated by the energy produced in an exothermic reaction between heating agents. The heating agents are usually oxygen gas blown onto the surface of the ferrous metal and aluminium (or silicon) dissolved in the molten ferrous metal. Aluminium (or silicon) is added to the molten ferrous metal at a controlled rate, whilst oxygen gas is simultaneously blown onto the surface of the ferrous metal at a controlled rate. However, in steel making the surface of the molten ferrous metal is covered with a layer of slag which inhibits the dissolving of the aluminium (or silicon) in the ferrous metal, and the transfer of oxygen gas to the surface of the ferrous metal, thereby reducing the efficiency of the heating process.

Sulphur is removed from the ferrous metal once it has been deoxidised. Desulphurisation is achieved by a chemical reaction between the sulphur dissolved within the molten ferrous metal and the slag thereon and, usually, injection of lime/spar and/or calcium containing agents such as calcium silicide. It is therefore desirable to have the maximum possible slag/molten metal contact surface for desulphurisation. As the sulphur content of the molten ferrous metal is reduced, its tendency to absorb nitrogen from the atmosphere increases. The absorption of nitrogen can have a detrimental effect on the properties of the finished product and it is therefore necessary to prevent or minimise the flow of nitrogen (or air containing nitrogen) across the surface of the molten ferrous metal during desulphurisation so as to minimise the pick-up of nitrogen by the metal.

The present invention provides a method of processing ferrous metals wherein the molten ferrous metal is stirred by bubbling a gas through the molten ferrous metal. A ring is then partially immersed in the molten ferrous metal within a substantially slag free portion of the surface of the molten ferrous metal to form a bounded substantially slag free area. The molten ferrous metal is heated by the introduction of exothermically reacting heating agents to the said slag free area and, the said ring is removed from the molten ferrous metal when the ferrous metal has reached a pre-determined temperature. Air is then excluded from the volume above the molten ferrous metal and sulphur removed therefrom.

Preferably the exothermically reacting agents are oxygen gas and granulated aluminium or ferro-silicon or a mixture thereof Preferably the method of the invention is such that air is excluded from the volume above the molten ferrous metal by placing a cover thereover and maintaining the volume at a higher pressure than that of the surrounding atmosphere.

The present invention also provides apparatus for processing ferrous metals including a receptacle for receiving the molten ferrous metal, a gas supply for bubbling gas through the molten ferrous metal, a moveable ring for defining a bounded substantially slag free area on the surface of the molten ferrous metal, and a moveable receptacle cover for excluding air from the volume above the surface of the molten ferrous metal; wherein the bubbling gas produces a substantially slag free portion on the surface of the molten ferrous metal, the said ring is moveable between a first position such that it is partially immersed in the molten ferrous metal substantially within the slag free portion produced by the bubbling gas and a second position such that it is separated from the molten ferrous metal, the receptacle cover is movable between a first position such that it excludes the surrounding atmosphere from the volume above the molten ferrous metal and a second position such that the volume is open to the surrounding atmosphere, and the receptacle cover and said ring are moveable independently of each other.

Preferably the apparatus of the present invention further includes control means for controlling the rate of supply of heating agents and monitoring means for determining the temperature of the molten ferrous metal wherein the control means form a closed loop control system.

BRIEF DESCRIPTION OF THE DRAWINGS

An embodiment of the invention will now be described, by way of example, with reference to the accompanying drawings

IN THE DRAWINGS

Figure 1:
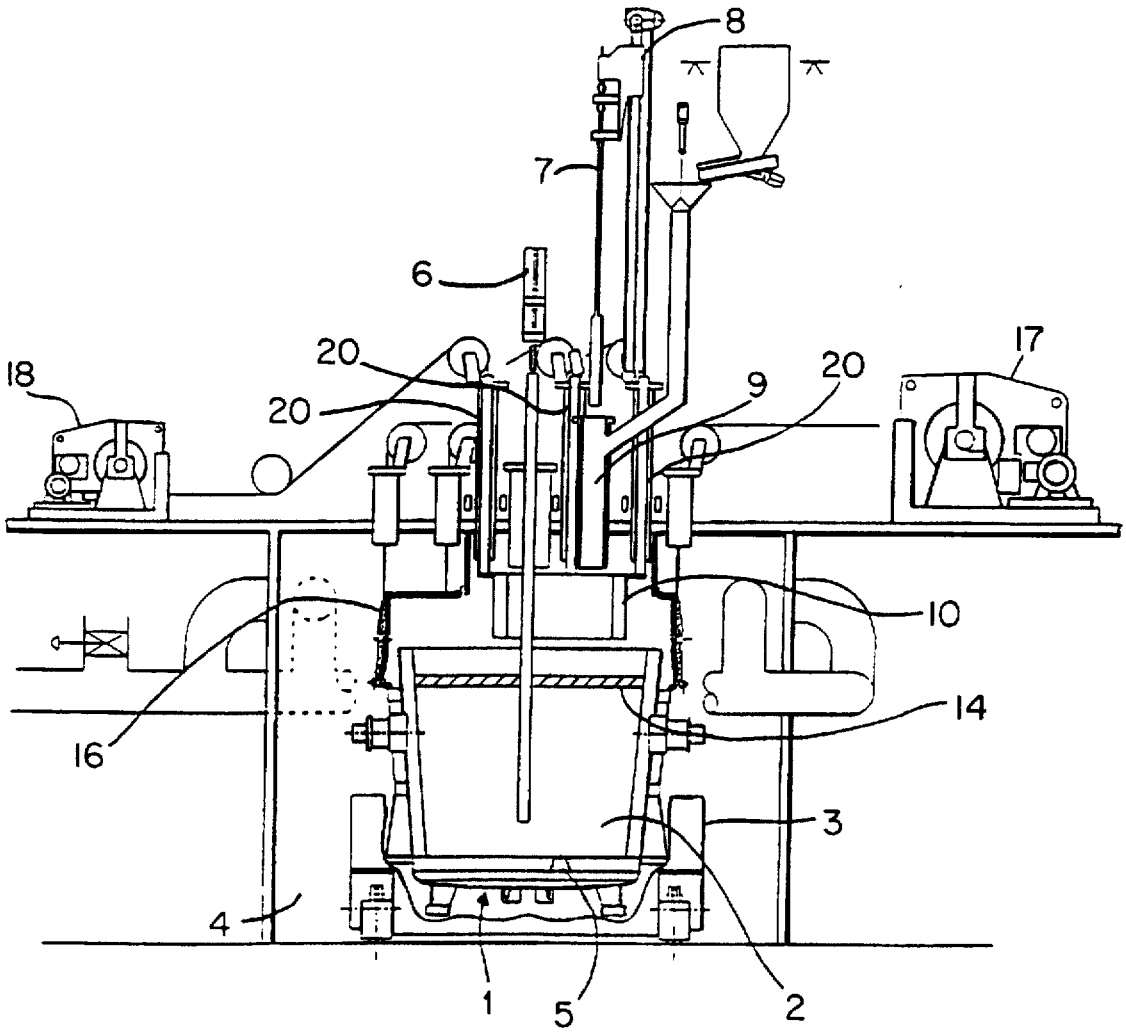
Figure 2:
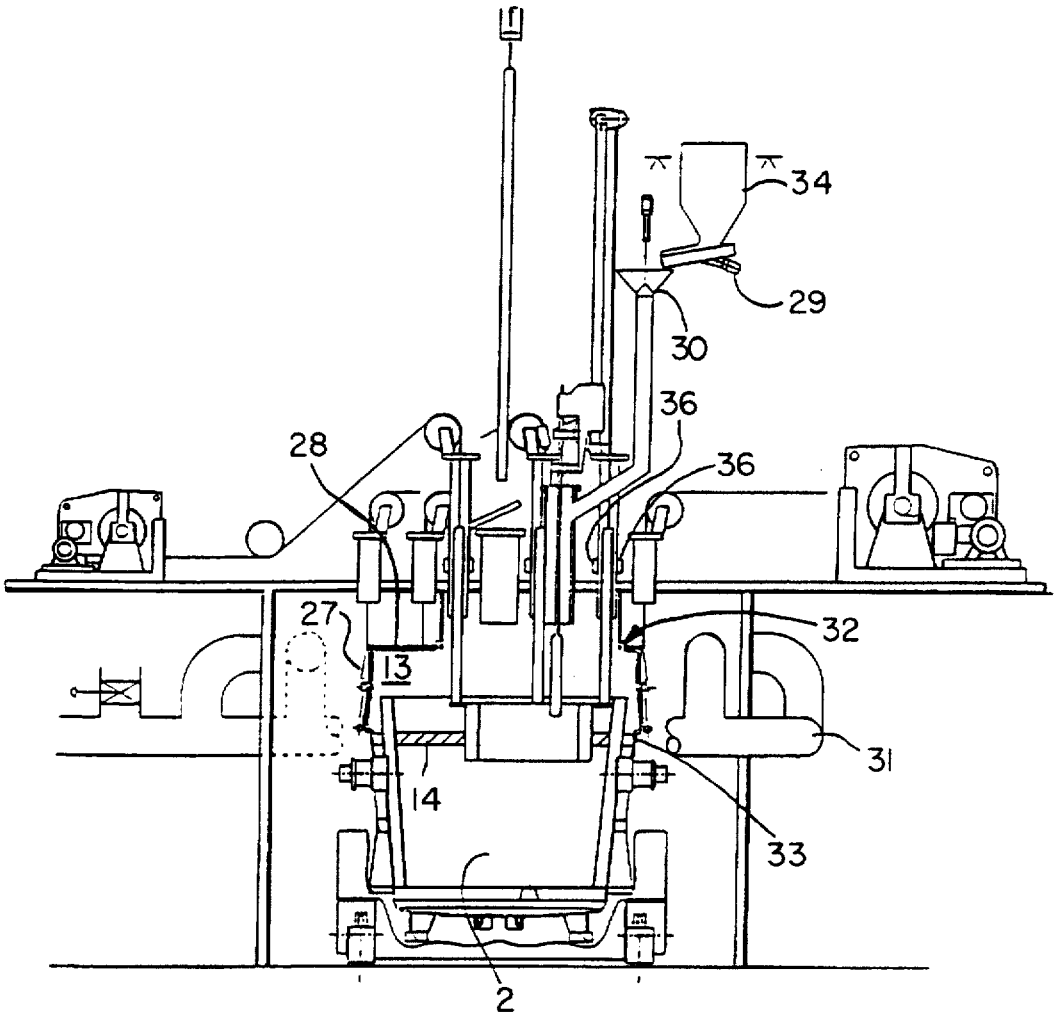
Figure 3:
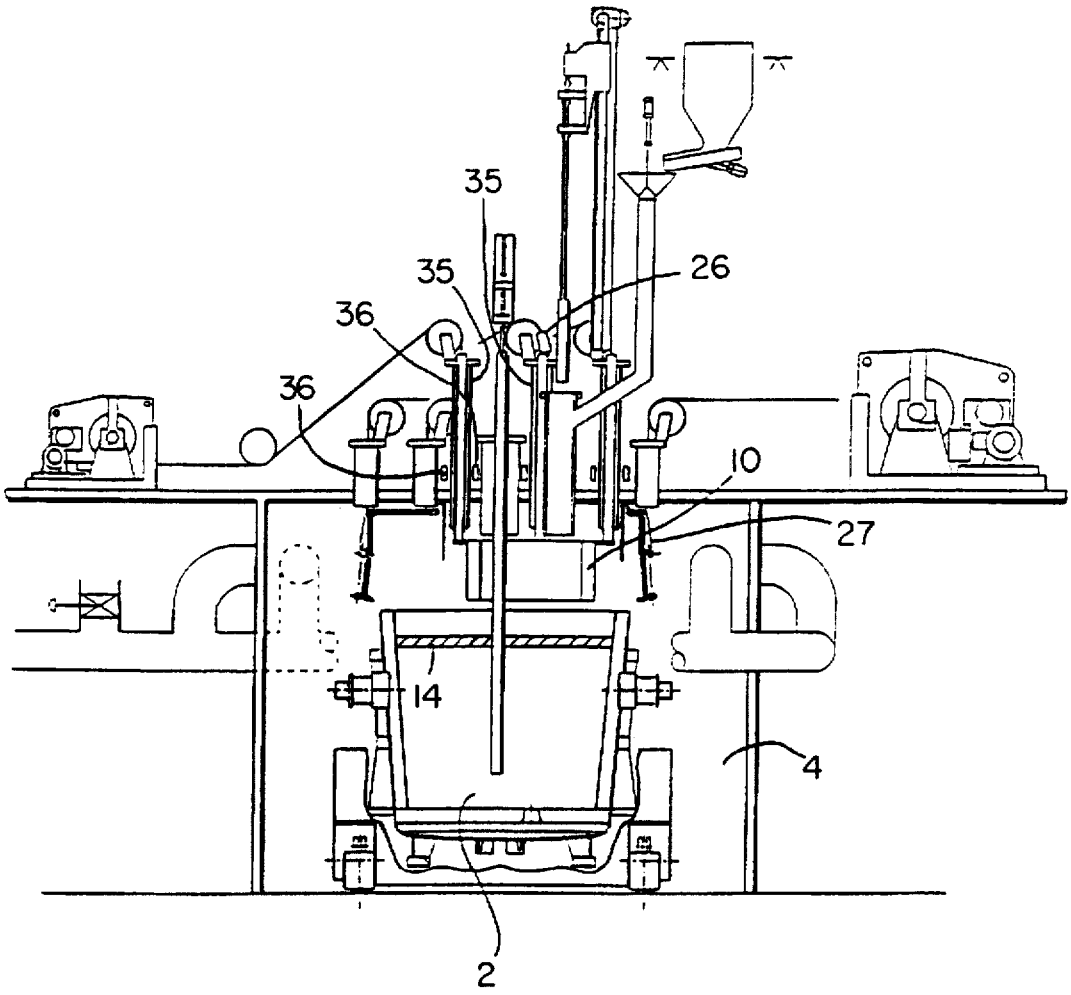

FIG. 1 is a transverse section through an apparatus for steel making embodying the present invention, with the receptacle cover in the first position and the ring in its second position;

FIG. 2 is a transverse section through an apparatus for steel making embodying the present invention with the receptacle cover in its first position and the ring in its first position; and FIG. 3 is a transverse section through an apparatus for steel making embodying the present invention, with the receptacle cover in the second position and the ring in its first second position.

Figure 4:
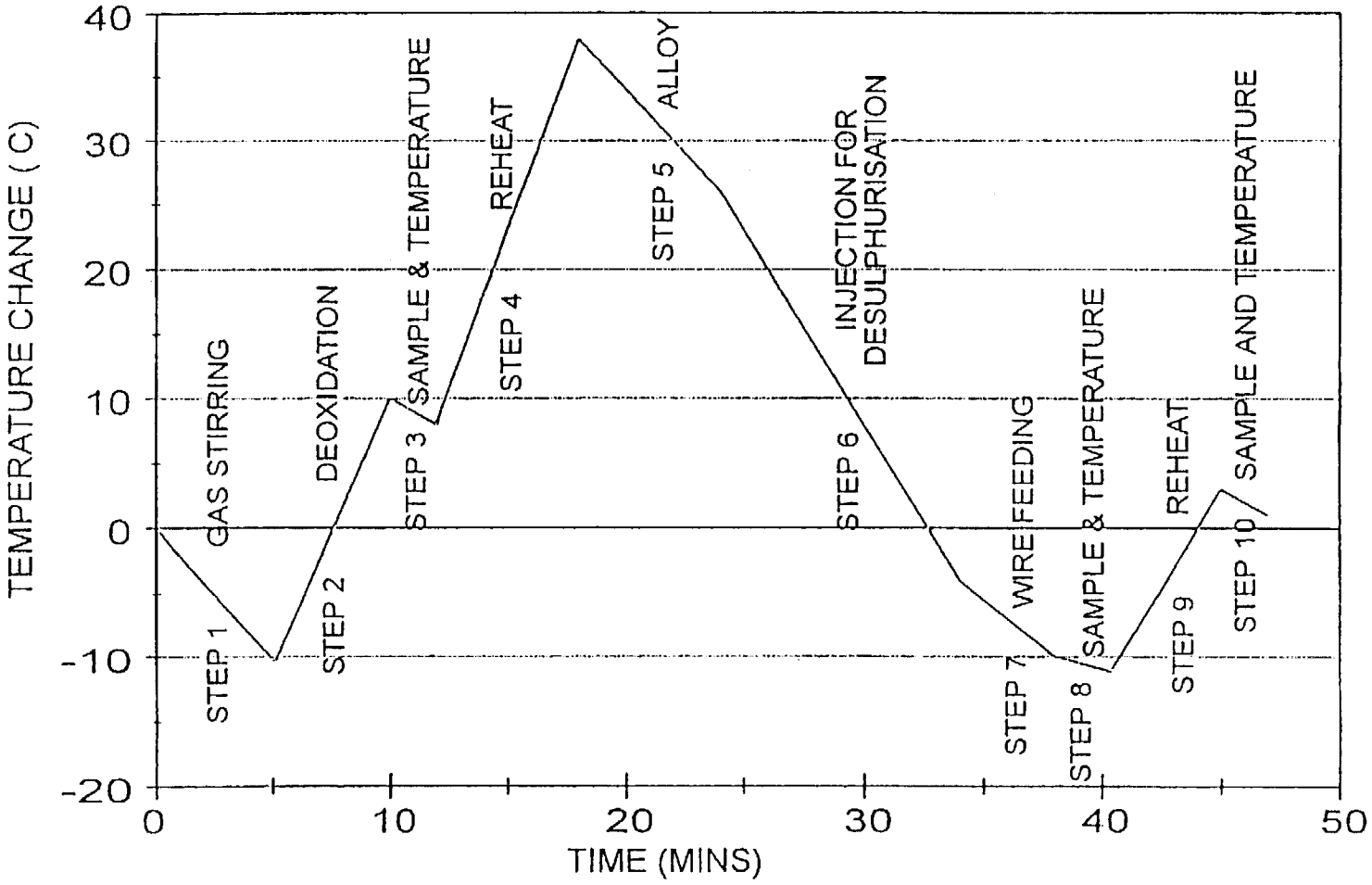
Figure 5:
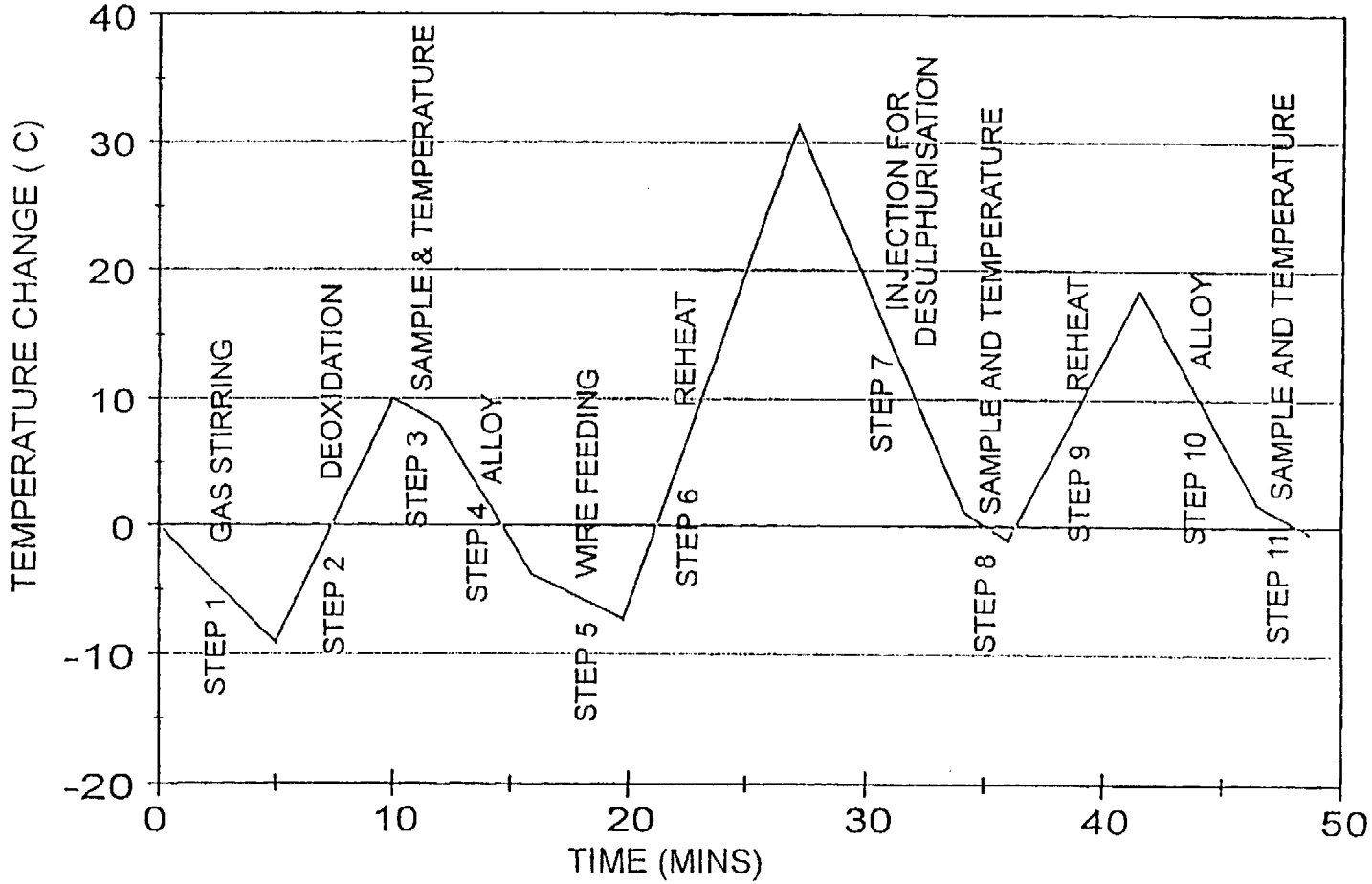

FIG. 4 is an illustration of Example 1 (Table 1);

FIG. 5 is an illustration of Example 2 (Table 2); and

Figure 6:
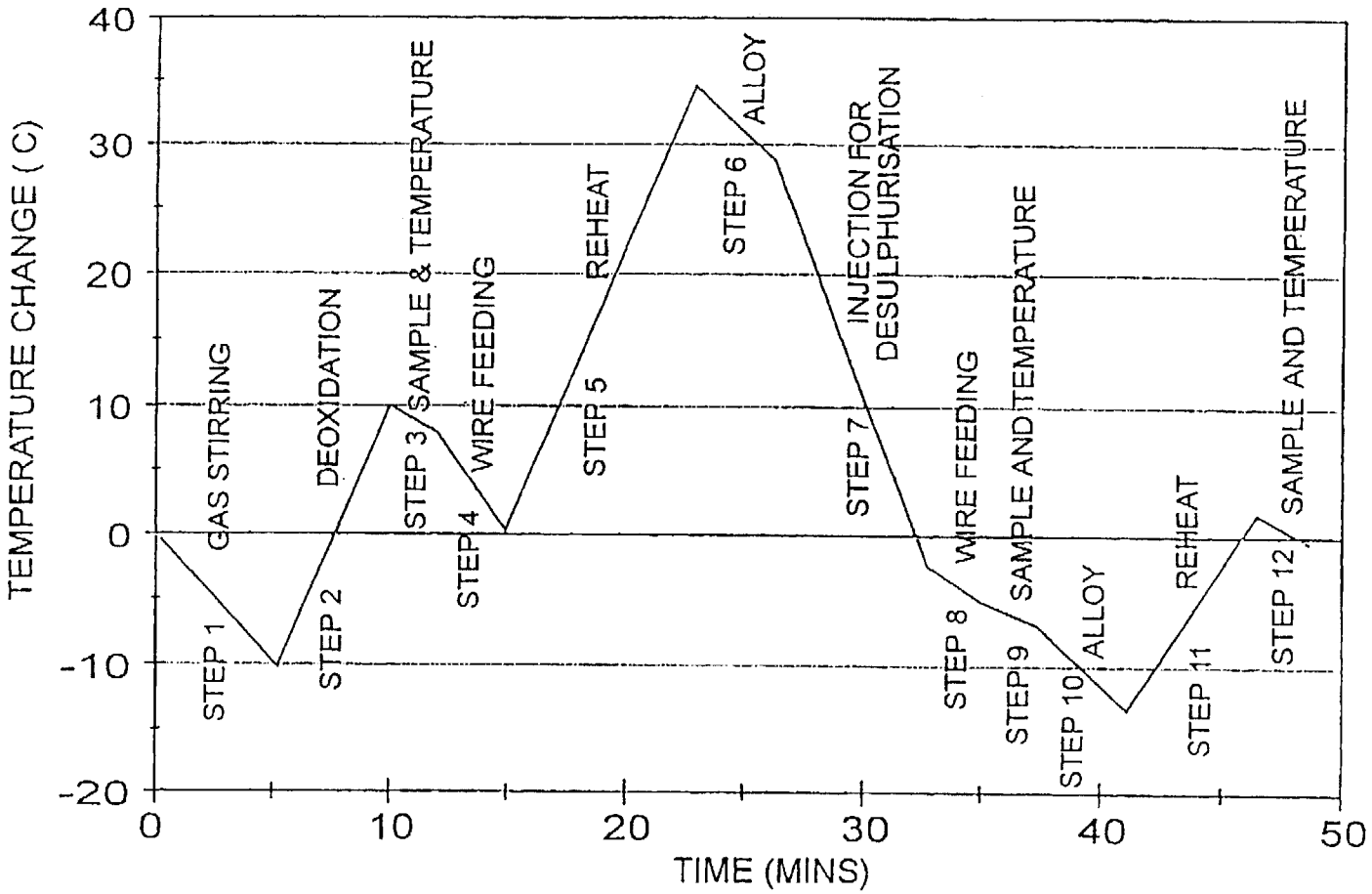

FIG. 6 is an illustration of Example 3 (Table 3).

Referring to FIG. 1, a ladle 1 carried on a ladle transport car 3 and containing deoxidised steel 2 is enclosed within a substantially airtight chamber 4.

The ladle 1 is provided with an argon stir bottom plug 5. The argon stir bottom plug 5 is a porous plug through which argon gas may be introduced into the molten steel. The steel is stirred by the introduction of the argon gas through the bottom plug 5. The vigorous bubbling of the inert argon gas stirs the ladle contents thereby homogenising the temperature and chemical composition of the molten steel. The flow rate of the argon gas can be adjusted to suit the metallurgical requirement. For example, the argon flow rate is reduced during heating to slow down the rate of dispersion of aluminium.

The chemical composition of the steel is adjusted by the addition of weighed amounts of deoxidants and ferro-alloys. Cooling of the liquid steel is done by the controlled addition of cooling scrap, added in the same way as other ferro-alloys.

There are two distinct layers in the ladle, a layer of molten steel 2 and a layer of slag 14 on the steel's surface.

The bubbling argon gas produces a slag free zone on the surface of the molten steel. The size of this slag free zone varies with the argon flow rate. The boundary of the slag free zone changes with the action of the gas and the slag free zone repeatedly expands and contracts.

The chamber 4 is provided with an argon stir top lance 6, an oxygen gas lance 7, an aluminium delivery tube 9, an refractory ring 10 and a water cooled ladle hood 16.

The oxygen lance 7 has a drive 8 which controls the separation between the oxygen outlet of the lance 7 and the surface of the molten steel. The position of the lance is automatically adjusted after each treatment to compensate or the wear of the lance.

The argon stir top lance 6 may be moved between a first position such that the outlet end of the lance 6 is immersed in the molten steel and the argon gas bubbles therethrough and a second position remote from the molten steel. The bubbling of the argon gas stirs the steel in a manner similar to that described above for the argon stir bottom plug 5. The argon stir top lance 6 may also be used to inject powdered additives into the liquid steel. Such additives are injected together with argon gas acting as their carrier.

A slag free zone is created on the surface of the steel by the argon bubbles breaking therethrough. This applies irrespective of whether the argon gas is introduced via the bottom plug 5 or top lance 6. The refractory ring 10 is lowered into the substantially slag free zone when this is at or near its greatest extent (or when it is at least as great as the diameter of the refractory ring). The partially immersed refractory ring then encloses a bounded substantially slag free area. This area will then remain substantially slag free whilst the ring 10 is so immersed. The ring 10 is a refractory faced steel cylinder supported by three arms 20, raised and lowered by a three rope winch system operated by the ring winch 18. The ring may have any circumferential shape provided that it defines a central aperture for enclosing the slag free area i.e. the ring need not be circular. When the ring has been lowered into its treatment position, the three vertical hangers, 35 which support the ring are clamped by three clamps, 36 to prevent further movement of the ring.

It is important to note that the use of the refractory ring has a beneficial effect on the efficiency of heating. The volume of metal enclosed within the ring is relatively small, at any given time, although the liquid steel within the ring is changed and recirculated by the effect of the argon stirring. Adding the aluminium to a relatively small volume of liquid steel means that oxygen is blown at a locally aluminium rich liquid. This encourages the reaction between oxygen and aluminium which is the required exothermic reaction rather than the undesired reaction between oxygen and other oxidisable elements such as iron, manganese and carbon. The use of the refractory ring therefore reduces losses of carbon and manganese quite significantly, as opposed to heating methods where the aluminium addition is rapidly diluted, as would be the case for example if the aluminium was added to the full volume of the steel in the ladle.

To increase the efficiency still further, the rate of aluminium addition is automatically controlled and monitored throughout the heating process, depending on the required rate of heating. The oxygen flow rate is also controlled and monitored throughout the heating process, in stoichiometric ratio with the addition rate of the aluminium, avoiding the oxidation of other elements. The ability of the apparatus of the invention to enclose a relatively small, slag free volume of steel is therefore highly advantageous.

A camera 26 is provided which allows the visual monitoring of the surface of the steel and/or slag within the ladle 1.

The argon top lance 6 may be lowered and immersed in the molten steel so as to promote stirring thereof as described above. The argon lance 6 may also be used for injecting suitable powdered desulphurisation agents (e.g. lime/spar and/or calcium containing agents such as calcium silicide).

It should be noted that although the bulk of the desulphurisation is done by the injection of a suitable powdered desulphurisation agent through an immersed top lance, significant desulphurisation results from contact between the slag layer and liquid steel layer. Maximum slag/molten steel surface contact is required so as to render desulphurisation as efficient as possible. For desulphurisation, therefore, the full surface area of the molten steel should be in contact with the slag. In addition, to maintain the highly reducing conditions required for desulphurisation and so as to minimise take up of nitrogen by the molten steel, the ingress of atmospheric oxygen and nitrogen respectively into the ladle must be minimised. This means that although the full area of the surface of the molten steel in the ladle should be exposed to the top slag layer, air should be excluded from the volume 13 above the molten steel and the slag.

The ladle hood 16 is water cooled and consists of two distinct portions, a moveable ladle cover portion 27 and a fixed ladle cover portion 28 with a seal member 32 therebetween. The moveable cover portion 27 may be moved from a first position where it is resting on the ladle trunnion band reinforcing flange 33 to a second position separated from flange 33 so as to allow communication between the volume 13 and the surrounding atmosphere. A positive pressure (larger than that of the surrounding atmosphere in the chamber 4) is created within the ladle cover 16 when this is in its first position. The ladle hood is sealed on the ladle trunnion band reinforcing flange, 33 rather than the ladle lip since the mating surface is much cleaner and flatter, thereby providing a more effective seal.

The moveable ladle cover portion 27 is raised and lowered by a hood winch 17. The ladle hood winch 17 and the refractory ring winch 18 are independently operable. This allows one to adjust the conditions within the ladle so as to maximise the efficiency of the heating and desulphurisation steps. This feature of the present invention allows one to maximise the efficiency of the steel making process despite the conflicting metallurgical requirements for the heating and desulphurisation processes.

The aluminium delivery tube 9 is fed from a hopper 34 via a vibratory feeder 29 and an addition hopper system 30. This addition hopper system prevents the emission of fumes during alloying, or the drawing of air into the volume 13 above the surface of the steel in the ladle 1. The airtight chamber 4 within which the ladle and its associated equipment are enclosed is provided with at least one fume extraction duct 31. This ensures that fume extraction is carried out from the chamber 4 surrounding the ladle, ladle transport car 3 and ladle hood 16 rather than directly from the ladle hood 16. The rear of the ladle transport car 3 is provided with a plate which coincides with the walls of the chamber 4 so as to form an airtight enclosure when the ladle transport car is in position within the apparatus of the present invention.

The pressure differential between the fixed hood and surrounding enclosure is constantly monitored during treatment. The measured differential is compared with a required figure. Any variation between the required and actual value is used to open or close an air ballast valve 37 in the exhaust duct. The air ballast valve, which is a butterfly type valve increases or decreases the air loading to the fume extraction system, effectively increasing or decreasing the extraction capacity. Modulating the extraction capacity is required to ensure a positive pressure within the fixed hood relative to the surrounding enclosure.

The method and apparatus described above allow one to optimise the conditions for distinct metallurgical operations having sometimes conflicting requirements.

The process is now illustrated by means of the following examples of time - temperature curves.

Example 1 As shown in FIG. 4 (Table 1)

The steel arrives at the installation in the unkilled (oxidised) state.

Step 1 The steel is argon stirred using bottom mounted porous plug, or tip lance, for homogenisation purposes.

Step 2 The steel is deoxidised by aluminium addition via the double gate addition hopper and alloy system, whilst the steel is argon stirred.

Step 3 The steel is sampled, and a temperature taken.

Step 4 The steel is reheated by oxygen top blowing with the refractory ring immersed by the simultaneous addition of aluminium (or ferro-silicon) whilst argon stirring using bottom plug or top lance.

Step 5 Based on the steel analysis, ferro-alloy additions are made via the double gate addition hopper and alloy system whilst argon stirring using bottom plug or top lance.

Step 6 The steel is desulphurised by the injection of lime/spar powder through a top lance using argon as a carrier gas.

Step 7 Sulphide modification is done by the injection of calcium into the steel in the form of a cored wire via a wire feed machine.

Step 8 The steel is sampled, and a temperature taken.

Step 9 The steel is reheated by oxygen top blowing with the simultaneous addition of aluminium (or ferro-silicon) whilst argon stirring using bottom plug or top lance.

Step 10 The steel is sampled, and a temperature taken.

Example 2 as shown in FIG. 5 (Table 2)

The steel arrives at the installation in the unkilled (oxidised) state.

Step 1 The steel is argon stirred using a bottom mounted porous plug or top lance, for homogenisation purposes.

Step 2 The steel is deoxidised by aluminium addition.

Step 3 The steel is sampled, and a temperature taken.

Step 4 Based on the steel analysis, ferro-alloy additions are made via the double gate addition hopper and alloy system whilst argon stirring using bottom plug or to lance.

Step 5 Alloying of special elements or for accurate analysis control can be carried out using cored or solid wires via the wire feed machine whilst argon stirring using bottom plug or top lance.

Step 6 The steel is reheated by oxygen top blowing with the refractory ring immersed by the simultaneous addition or aluminium (or ferro-silicon) whilst argon stirring using bottom plug or top lance.

Step 7 The steel is desulphurised by the injection of lime/spar powder through a top lance using argon as a carrier gas.

Step 8 The steel is sampled, and a temperature taken.

Step 9 The steel is reheated by oxygen top blowing with the simultaneous addition of aluminium (or ferro-silicon) whilst argon stirring using bottom plug or top lance.

Step 10 Final fine trimming additions are made based on the steel analysis using ferro-alloys via the double gate addition hopper and alloy system whilst argon stirring using bottom plug or top lances.

Step 11 The steel is sampled, and a temperature taken.

Example 3 as shown in FIG. 6 (Table 3)

Step 1 The steel is argon stirred using a bottom mounted porous plug or top lance, for homogenisation purposes.

Step 2 The steel is deoxidised by aluminium addition.

Step 3 The steel is sampled, and a temperature taken.

Step 4 Based on the steel analysis, cored or solid wire additions are made via the wire feed machine whilst argon stirring using the bottom plug or top lance.

Step 5 The steel is reheated by oxygen top blowing with the simultaneous addition of aluminium (or ferro-silicon) whilst argon stirring using bottom plug or top lance.

Step 6 Based on the steel analysis, ferro-alloy additions are made via the double gate addition hopper and alloy system whilst argon stirring using bottom plug or top lance.

Step 7 The steel is desulphurised by the injection of lime/spar powder through a top lance using argon as a carrier gas.

Step 8 Sulphide modification is done by the injection of calcium into the steel in the form of a cored wire via a wire feed machine.

Step 9 The steel is sampled, and a temperature taken.

Step 10 Final fine trimming additions are made based on the steel analysis using ferro-alloys via the double gate addition hopper and alloy system whilst argon stirring using bottom plug or top lances.

Step 11 The steel is reheated by oxygen top blowing with the simultaneous addition of aluminium (or ferro-silicon) whilst argon stirring using bottom plug or top lance.

Step 12 The steel is sampled, and a temperature taken.

I claim:

1. A method of processing molten ferrous metals containing at least some sulphur in a metallurgical vessel having a metal melt therein, said melt having an upper surface, said upper surface having slag thereon and said metallurgical vessel including a movable ring, the method including the steps of:

producing a substantially slag free surface portion of the surface of said melt;

partially immersing said ring in said melt in said substantially slag-free surface portion to form a bounded substantially slag-free area of said surface;

delivering exothermically reacting heating agents to the said slag-free area to heat said melt;

removing said ring from said melt when said melt has reached a selected temperature;

enclosing and sealing a volume above and bounded by said melt so as to exclude air from said volume above the melt; and removing sulphur from said melt.

2. The method of claim 1 in which said exothermically reacting agents are oxygen gas and granulated material selected from the group consisting of aluminum, ferro-silicon or a combination thereof.

3. The method of claim 1 in which said step of removing sulphur comprises the step of introducing of powdered material selected from the group consisting of lime, spar, calcium silicide or a combination thereof, into said melt.

4. The method of claim 2 in which said step of removing sulphur comprises the introduction of powdered material selected from the group consisting of lime, spar, calcium silicide or a combination thereof, into said melt.

5. The method of claim 1 in which said step of excluding air from said volume above said melt comprises the step of placing a cover over said volume and maintaining said volume at a higher pressure than that of the surrounding atmosphere.

6. The method of claim 2 in which said step of excluding air from said volume above the melt comprises the step of placing a cover over said volume and maintaining said volume at a higher pressure than that of the surrounding atmosphere.

7. The method of claim 3 in which said step of excluding air from said volume above the melt comprises the step of placing a cover over said volume and maintaining said volume at a higher pressure than that of the surrounding atmosphere.

8. Apparatus for processing ferrous metals comprising; a receptacle for receiving molten ferrous metal, a gas supply for bubbling gas through said molten ferrous metal in said receptacle, a ring movable within and relative to said receptacle between a position partially within said molten ferrous metal and a position out of said molten metal, a receptacle cover movable relative to said receptacle to open and close said receptacle, a first control which controllably moves said ring, and a second control which controllable moves said receptacle cover, said first and second controls being independently operable so that said receptacle cover and said ring are movable independently of each other.

9. Apparatus according to claim 8 wherein said ring encloses an area within said receptacle and the apparatus further comprises a heating agent supply which supplies exothermically reacting heating agents to said area enclosed by said ring within said receptacle.

10. Apparatus according to claim 9 wherein said heating agent supply spplies oxygen gas and granulated material selected from the group consisting of aluminum, ferrosilicon or a combination thereof.

11. Apparatus according to claim 8 further comprising means for supplying powdered materials selected from the group consisting of lime, spar, calcium silicide or a combination thereof, to said receptacle whilst said receptacle cover is closing said receptacle.

12. Apparatus according to claim 9 further comprising means for supplying powdered materials selected from the group consisting of lime, spar, calcium silicide or a combination thereof to said receptacle whilst said receptacle cover is closing said receptacle.

13. Apparatus according to claim 10 further comprising means for supplying powdered materials selected from the group consisting of lime, spar, calcium silicide or a combination thereof to said receptacle whilst said receptacle cover is closing said receptacle.

14. Apparatus according to claim 10 including an addition hopper system for supplying said granulated material.

15. Apparatus according to claim 8 wherein said receptacle cover closes said receptacle to enclose a volume above and bounded by said receptacle and the contents of said receptacle, said enclosed volume being separated by said receptacle and receptacle cover from a space surrounding said closed receptacle, said receptacle including:

pressure measurement means for measuring the relative pressures of the volume enclosed within said closed receptacle and said space surrounding said closed receptacle; and a fume extraction line connected to said space and having controllable fume extraction means to extract gases or fumes from said space, said fume extraction means being connected to said pressure measurement means;

said measurement of relative pressures made by said pressure measurement means controlling the fume extraction means to maintain said enclosed volume at a higher pressure than said space surrounding said receptacle.

16. Apparatus according to claim 11 wherein said receptacle cover closes said receptacle to enclose a volume above and bounded by said receptacle and the contents of said receptacle, said enclosed volume being separated by said receptacle and receptacle cover from a space surrounding said closed receptacle, said receptacle including:

pressure measurement means for measuring the relative pressures of the volume enclosed within said closed receptacle and said space surrounding said closed receptacle; and a fume extraction line connected to said space and having controllable fume extraction means to extract gases or fumes from said space, said fume extraction means being connected to said pressure measurement means;

said measurement of relative pressures made by said pressure measurement means controlling the fume extraction means to maintain said enclosed volume at a higher pressure than said space surrounding said receptacle.

17. Apparatus according to claim 12 wherein said receptacle cover closes said receptacle to enclose a volume above and bounded by said receptacle and the contents of said receptacle, said enclosed volume being separated by said receptacle and receptacle cover from a space surrounding the closed receptacle, said receptacle including:

pressure measurement means for measuring the relative pressures of the volume enclosed within said closed receptacle and said space surrounding said closed receptacle; and a fume extraction line connected to said space and having controllable fume extraction means to extract gases or fumes from said space, said fume extraction means being connected to said pressure measurement means;

said measurement of relative pressures made by said pressure measurement means controlling the fume extraction means to maintain said enclosed volume at a higher pressure than said space surrounding said receptacle.

18. Apparatus according to claim 15 wherein said space surrounding said receptacle and receptacle cover is enclosed within a chamber provided with a fume extraction duct having an air ballast valve.

19. Apparatus according to claim 8 further comprising a heating control which controls the rate of supply of said exothermically reacting heating agents to said receptacle, and a monitor for determining the temperature of the contents of said receptacle, said monitor producing a temperature signal representative of the temperature of the contents of said receptacle, said heating control including a comparator for comparing said monitor temperature signal to a signal representative of a desired temperature to produce a comparison signal, said rate of supply of said heating agents being controllably varied as a function of said comparison signal.

20. Apparatus according to claim 8 wherein said receptacle and receptacle cover are enclosed within a chamber provided with a fume extraction duct.

* * * * *

UNITED STATES PATENT AND TRADEMARK OFFICE

CERTIFICATE OF CORRECTION

PATENT NO. : 5,762,682

DATED : June 9, 1998

INVENTOR(S) : John Rushe

It is certified that error appears in the above-identified patent and that said Letters Patent is hereby corrected as shown below:

TITLE PAGE:

Assignee "Vacmetal Limited" should read – Vacmetal (UK) Limited–.

Signed and Sealed this

Sixteenth Day of February, 1999

*Attest:*

*Attesting Officer*

*Acting Commissioner of Patents and Trademarks*